United States Patent [19]

Kurtz et al.

[11] 4,198,277

[45] Apr. 15, 1980

[54] ELECTROLYSIS OF AQUEOUS SALT SOLUTIONS

[75] Inventors: Bruce E. Kurtz, Marcellus; Robert H. Fitch, Syracuse, both of N.Y.

[73] Assignee: Allied Chemical Corporation, Morris Township, Morris County, N.J.

[21] Appl. No.: 934,757

[22] Filed: Aug. 21, 1978

Related U.S. Application Data

[63] Continuation-in-part of Ser. No. 866,120, Dec. 30, 1977, abandoned.

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS 3,321,388 5/1967 Veda et al. ..... 204/128

*Primary Examiner*—R. L. Andrews

*Attorney, Agent, or Firm*—Michael S. Jarosz; Anthony J. Stewart

[57] ABSTRACT

An electrolysis process is disclosed in which catholyte is transferred serially from one cell, in a bank of a plurality of cells, to the cathode compartment of a succeeding cell in the bank. The transfer is accomplished by means of a gas-lift in which gas, present in the cathode compartment rises through a confined space, which is dimensioned such that the gas serves to lift the catholyte upward to a point where the gas and liquid separate and the liquid catholyte is allowed to fall freely to a collection point from which it is introduced into the cathode compartment of a succeeding cell.

3 Claims, 1 Drawing Figure

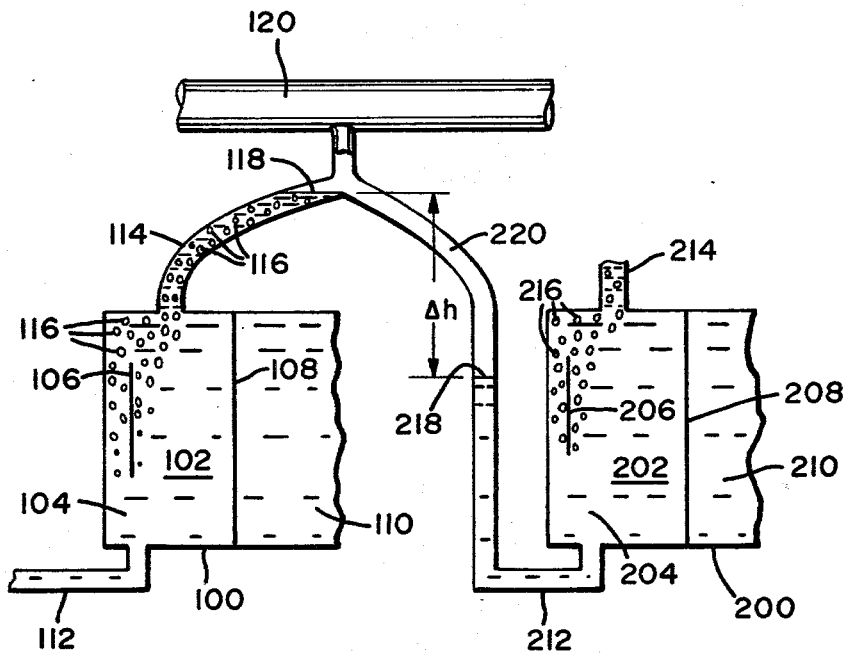
120
118
114
116
220
214
216
Δh
116
106
108
218
206
208
102
202
210
104
110
204
100
200
112
212

ELECTROLYSIS OF AQUEOUS SALT SOLUTIONS

CROSS-REFERENCE TO RELATED APPLICATION

This application is a continuation-in-part of Ser. No. 866,120, filed Dec. 30, 1977, now abandoned.

BACKGROUND OF THE INVENTION

The electrolysis of aqueous salt solutions in permselective membrane electrolytic cells is well documented in the literature as are the advantages and disadvantages associated therewith. It is known, for example, that when employing such cells for the production of sodium hydroxide (caustic soda) and chlorine from sodium chloride brines, the current efficiency decreases as the concentration of sodium hydroxide in the catholyte increases. It is of course desirable to be able to produce relatively concentrated caustic soda solutions without recourse to separate concentration procedures and with acceptable current efficiencies. One method for attaining this end is disclosed in U.S. Pat. No. 4,057,474 wherein there is described a process involving the flow of catholyte sodium hydroxide solutions exiting from one cell to the catholyte compartment of a succeeding cell in a bank. This "series catholyte flow" process results in the recovery of relatively concentrated sodium hydroxide solutions directly from the last of the cells in a series and at the same time, the average current efficiency for the cells in the series is well within the acceptable range. German Offenlegungsschrift 2,437,783 and U.S. Pat. No. 4,076,603 also describe a series catholyte flow process.

While such series catholyte flow results in substantial improvement in current efficiency, certain problems have become apparent in operating a bank of cells with series flow. Some means must be provided for transferring the catholyte from one cell to another. This can be accomplished with conventional pumps, but this requires additional equipment and, depending on how the cells are serially connected, a breakdown of just one pump could conceivably disrupt the whole operation. While the use of gravity flow has been postulated, commercial operation involves a large number of cells in a bank, and thus gravity becomes impractical because of design and/or operational problems associated with the necessity that succeeding cells connected together in series catholyte flow must necessarily be at lower elevations in order for flow from one cell to the next to occur. Additionally, when succeeding cells are at a different voltage, as in a filter press type bipolar cell stack or among individual monopolar cells connected via a series electrical circuit, the transfer of catholyte from one cell to another should be done in such a manner as to insure electrical isolation of one cell from another.

It is an object of this invention to provide a process for operating a bank of electrolytic cells connected for series catholyte flow. It is a further object of this invention to provide a process for transferring catholyte from one cell to another which does not require external pumping means and which serves to substantially isolate the cells electrically. These and other objects will become apparent from the description which follows.

SUMMARY OF THE INVENTION

In accordance with this invention, there is provided an improved process for operating a bank of a plurality of electrolytic cells, wherein each cell has an anode compartment and cathode compartment, the compartments being separated by a cationic permselective membrane, and sodium hydroxide catholyte is transferred serially from the cathode compartment of one or more preceding cells to the cathode compartment of at least one succeeding cell in the bank. The improvement comprises effecting the transfer and providing electrical isolation of the cathode compartments by means of gas-lift in which hydrogen, produced in the cathode compartment of a preceding cell rises through the sodium hydroxide catholyte solution in a confined space and lifts the catholyte solution to a disengaging point at which the hydrogen is separated and the catholyte solution is allowed to fall freely through a confined void space to a predetermined point wherein it is collected and fed by gravity to the cathode compartment of a succeeding cell at approximately the same elevation as the preceding cell. Effective transfer and isolation are provided by regulating the current density on the cathodes of the preceding cells such that $KC_d=D/H$, as defined hereinafter.

This "gas-lift" method for transferring catholyte serially from one cell to another results in a most advantageous method of operating a bank of cells. Auxillary equipment is not required to transfer the catholyte and the difficulties associated with the use of gravity alone, as outlined above, are avoided. Further, allowing the liquid catholyte, as it separates from the hydrogen gas, to fall freely through a confined void space to a collection point serves to electrically isolate the cells thereby preventing current from passing, via the catholyte, to the succeeding cell.

BRIEF DESCRIPTION OF THE DRAWING

The drawing is a schematic flow diagram illustrating a bank of two permselective membrane cells employing series catholyte flow in accordance with this invention.

DETAILED DESCRIPTION OF THE INVENTION

The invention comprises a method for accomplishing series catholyte flow in a multi-compartment bipolar permselective membrane electrolyzer which utilizes the hydrogen gas evolved in the cathode compartment for an autogenous gas-lift in order to transport the catholyte from the cathode compartment of one cell to the cathode compartment of the next cell, and to establish a high electrical resistance in the stream of catholyte between the exit of the preceding cell and the entrance of the succeeding cell so as to electrically isolate the cathode compartment of the preceding cell from the cathode compartment of the succeeding cell.

In the electrolysis of sodium chloride brine, the invention utilizes the hydrogen gas generated within the cathode compartment to raise the catholyte caustic soda liquid through a riser pipe from the top of a preceding cathode compartment to a disengaging device wherein the hydrogen is separated from the catholyte, the catholyte then falls freely downward through a void confined space in a downcomer, to a level from which it flows, by gravity, into the bottom of a succeeding cathode compartment. The height of the void space is dictated by the difference in the bulk density of the two phase system (catholyte liquid and hydrogen gas) in the preceding cathode compartment and the bulk density of the single phase (catholyte liquid) in the downcomer leading to the bottom of the succeeding cell.

The invention is more clearly illustrated by reference to the drawing wherein there are illustrated two cells 100 and 200 connected for series catholyte flow. Each cell has a cathode compartment 104 and 204, and an anode compartment 110 and 210 separated by permselective membranes 108 and 208, respectively. Each cathode compartment has a cathode 106 and 206. Lines 112 and 212 feed into the cathode compartments containing catholyte 102 and 202, respectively. The upper portion of each catholyte compartment is equipped with risers 114 and 214 through which the catholyte flows by means of a gas-lift generated by hydrogen gas bubbles 116 and 216. The gas and liquid caustic soda separate at separation point 118 from which the gas flows upward into header 120 and the liquid drops through void space 220 to collection point 218.

In operation of the process of this invention, water from an external source, or catholyte from a preceding cell, is fed via line 112 into cathode compartment 104. Regardless of the feed, water is electrolyzed at cathode 106 to provide hydroxyl ions and hydrogen gas which forms bubbles 116. Sodium ions from anode compartment 110 migrate through permselective membrane 108 into the catholyte compartment to form aqueous caustic soda. The hydrogen gas bubbles and the aqueous caustic soda catholyte form a two-phase system which flows from the cathode compartment 102 through riser 114 up to separation point 118. At the separation point, the hydrogen gas passes into header 120 while the liquid caustic soda catholyte is allowed to fall freely through confined void space 220 to collection point 218. The dimensions of riser 114 and void confined space 220 are selected such that at separation point 118, the flowing liquid will occupy only a small portion of the available cross section, thus preventing the entrainment of hydrogen gas in the liquid catholyte as it falls to collection point 218 and also to allow the liquid catholyte to fall freely, thus preventing electrical current from passing from cell 100 to cell 200. The liquid catholyte flows from collection point 218, via gravity, through feed 212 into catholyte compartment 204 of the succeeding cell 200 wherein the water in the catholyte compartment is electrolyzed at cathode 206 resulting in a repeat of the process occuring in cell 100.

The difference between the height of the separation point 118 and the collection point 218 is designated in the drawing as $\Delta h$ and is approximately proportional to the difference between the effective density of the two phase system in riser 114 (liquid catholyte and hydrogen gas) and the single phase system in feed 212 (catholyte liquid). This $\Delta h$ will, of course, be a maximum for a no-flow condition and will be reduced to some extent by resistance to flow in 114 and 212. However, proper design of these lines will make the resistance to flow negligible at usual flow rates.

The extent of the difference in effective density between the catholyte-hydrogen mixture and the catholyte falling through void space 220 to collection point 218 determines the effective gas-lift and it depends on the relative volumes of catholyte and hydrogen present in the cathode compartment. This, in turn, depends on the physical properties of the catholyte and hydrogen, the size of the bubbles formed and the horizontal cross-sectional area of the cathode compartment. It is only this latter factor which can be controlled by the design of the electrolyzer and it will be evident that the cross-sectional area should be established within certain limits in order to assure proper operation.

In the case where the horizontal cross-sectional area of the cathode compartment is very large, the hydrogen bubbles will occupy only a small fraction of the total cathode compartment volume and there will accordingly be little difference in density between the contents of the cathode compartment and the liquid catholyte along resulting in too small a gas-lift effect and too small a $\Delta h$ to accomplish adequate electrical isolation between the cathode compartments. For the case where the horizontal cross-sectional area of the cathode compartment is very small, the hydrogen bubbles will occupy a large fraction of the total cathode compartment volume, hence, $\Delta h$ will be more than large enough to accomplish adequate electrical isolation. However, because the hydrogen will occupy such a large fraction of the cathode compartment volume, the resistance to the flow of electrical current through the catholyte will be increased causing the cell to operate at too high a voltage.

Accordingly, in the preferred practice of this invention, the horizontal cross-sectional area of the cathode compartment should be confined within certain limits. The cathode compartment horizontal cross-sectional area required for satisfactory gas-lift effect will depend on the volumetric rate of hydrogen evolution. More specifically, it will be proportional to the product of the cathode area and the current density according to the equation $$DW = KHWC_d$$

wherein

D = depth of cathode compartment,
W = width of cathode compartment,
H = height of cathode compartment,
$C_d$ = current density on cathode,
K = proportionality constant.

Accordingly, the required current density on the cathode is given by the equation $KD_d = D/H$.

It has been found, according to the present invention, that for operation at or near atmospheric pressure, producing caustic soda in concentrations of 7 to 20 weight percent at a temperature in the range of 30° to 90° C., the proportionality constant K should be in the range of 0.01 to 2.0, preferably, 0.05 to 1.0. At K values less than about 0.01 the cell will operate at an undesirably high voltage due to the large fraction of the catholyte compartment occupied by the hydrogen. At K values more than about 2.0, the rate of hydrogen evolution will be insufficient to create the necessary gas-lift effect.

DESCRIPTION OF PREFERRED EMBODIMENTS

In the following examples, data were obtained from a three cell electrolyzer in which the individual cells were assembled together so that common end plates served to separate the cathode compartment of one cell from the anode compartment of the adjacent cell. The cathode of each individual cell is electrically connected externally to the anode of the adjacent cell. As illustrated in the drawing, the catholyte and hydrogen from the first cell exits from the top of the cell body into an external disengaging point from which the catholyte flows downward through a confined void space and thence into the bottom of the adjacent second cell and so on from the second cell to the third cell. Caustic soda at the final concentration is withdrawn from the top of the third cell.

The anodes employed were constructed of titanium coated with rare earth metal oxides and available under the trade name "DSA". The cathode was mild steel. The membrane was a cationic permselective membrane supplied under the trade name "Nafion". The current density employed was 0.25 amps/cm$^2$. The pressure within the anode compartment was maintained at about 7 inches of water, that within the cathode compartment at about 1 inch of water.

Example 1 comprises the average result of two runs at approximately the same final caustic concentration, Example 2 is the average of 3 runs at approximately the same final caustic concentration, and Example 3 is the average of 2 runs at approximately the same final caustic concentration. The duration of each run was approximately 1 hour. The results are shown in the Table.

TABLE

| | Example 1 | Example 2 | Example 3 |
|---|---|---|---|
| Operating Conditions | | | |
| Feed Brine Concentration (g/l) | 322 | 317 | 312 |
| Brine Depletion (%) | 11.4 | 10.8 | 10.6 |
| Average Cell Temperature (°C.) | 82 | 82 | 84 |
| E.M.F. Applied (volts) | | | |
| Cell #1 | 4.2 | 4.2 | 4.0 |
| Cell #2 | 3.8 | 3.9 | 3.7 |
| Cell #3 | 4.2 | 4.4 | 4.3 |
| Average | 4.1 | 4.2 | 4.0 |
| Cell Efficiencies (% based on NaOH produced) | | | |
| Voltage efficiency | 55.0 | 53.5 | 55.7 |
| Current efficiency | 91.7 | 90.4 | 83.2 |
| Power efficiency | 50.0 | 48.4 | 46.3 |
| NaOH Concentration (weight %) | | | |
| Cell #1 | 6.0 | 4.6 | 8.5 |
| Cell #2 | 10.1 | 7.8 | 13.8 |
| Cell #3 | 13.5 | 10.9 | 17.8 |
| Power Consumption (KWh/ton NaOH) | 2695 | 2800 | 2930 |

For all of these runs, the value of K discussed above is calculated to be about 0.5 on the basis of H=10 cm, $C_d$=0.25 amps/m$^2$, and D=1.2 cm. In all the runs, the voltage was satisfactorily low. The difference in level between the separation point and the collection point was, in all cases, in the range of 3 to 6 cm, quite satisfactory for electrical isolation between adjacent cathode compartments. For periods of operation at current densities less than 0.25 amps/cm$^2$, it was observed that the difference in catholyte levels between adjacent cathode compartments was diminished, but was still adequate (2–3 cm), at current densities in the range of 0.12 amps/cm$^2$, corresponding to a K value of about 1.0.

As compared to the alternative of a mechanical pump for transporting the catholyte, the autogenous gas-lift method of this invention avoids increased complexity and cost, and decreased reliability of the electrolyzer. It also utilizes the energy generated by the buoyancy of the hydrogen bubbles which would otherwise be wasted. As compared to the alternative of gravity flow for transporting the catholyte, the gas-lift method avoids the need for having adjacent cathode compartments at successively lower positions which would seriously complicate the design and increase the cost of the electrolyzer. As regards the necessity for a high electrical resistance in the stream of catholyte for a series catholyte flow, the gas-lift method of this invention accomplishes this by creating a discontinuity in the catholyte stream where the stream falls freely through a confined void space created by the difference in head.

We claim:

1. In a process for producing chlorine and sodium hydroxide wherein aqueous sodium chloride is electrolyzed in a bank of a plurality of electrolytic cells, each cell having a cathode compartment and an anode compartment separated by a cationic permeable membrane, the improvement which comprises:

(a) transferring the catholyte serially from the cathode compartment of one or more preceding cells to the cathode compartment of at least one succeeding cell in the bank and providing electrical isolation between the cathode compartment by means of a gas-lift in which hydrogen produced in the cathode compartment rises through the sodium hydroxide catholyte solution in a confined space and lifts said catholyte solution to a disengaging point where the hydrogen is separated and the catholyte is allowed to fall freely through a confined void space to a predetermined point where it is collected and fed by gravity to the cathode compartment of a succeeding cell; and (b) maintaining the electric current on the cathode in said preceding cells such that $C_dK=D/H$, wherein $C_d$ is the current density, D is the depth of the cathode compartment, H is the height of the cathode compartment and K is a proportionality constant having a value between 0.01 and 2.0.

2. A process according to claim 1 wherein K has a value between 0.05 and 1.0.

3. The method according to claim 1 wherein the difference between the hydraulic head generated by the presence of hydrogen gas in the catholyte solution and the hydraulic head required to feed the succeeding cell by gravity is equal to the difference in height between the separation point and the collection point.

* * * * *